US011235922B2

(12) United States Patent
Fang

(10) Patent No.: US 11,235,922 B2
(45) Date of Patent: Feb. 1, 2022

(54) FLUID DISCHARGE SYSTEM AND SQUEEZER THEREOF

(71) Applicant: SHANGHAI HONGYAN RETURNABLE TRANSIT PACKAGINGS CO., LTD., Shanghai (CN)

(72) Inventor: Zhengwei Fang, Shanghai (CN)

(73) Assignee: SHANGHAI HONGYAN RETURNABLE TRANSIT PACKAGINGS CO., LTD., Shanghai (CN)

( * ) Notice: Subject to any disclaimer, the term of this patent is extended or adjusted under 35 U.S.C. 154(b) by 12 days.

(21) Appl. No.: 16/636,301

(22) PCT Filed: Jul. 27, 2018

(86) PCT No.: PCT/CN2018/097328
§ 371 (c)(1),
(2) Date: Feb. 3, 2020

(87) PCT Pub. No.: WO2019/024769
PCT Pub. Date: Feb. 7, 2019

(65) Prior Publication Data

US 2021/0179347 A1 Jun. 17, 2021

(30) Foreign Application Priority Data

Aug. 3, 2017 (CN) ..... 201710656555.5

(51) Int. Cl.
*B65D 88/54* (2006.01)
*B65D 77/06* (2006.01)
(Continued)

(52) U.S. Cl.
CPC ..... *B65D 88/54* (2013.01); *B65D 77/065* (2013.01); *B65D 90/00* (2013.01); *B67D 7/0216* (2013.01);
(Continued)

(58) Field of Classification Search
CPC ..... B65D 88/54; B65D 77/065; B65D 2590/046; B65D 90/00; B67D 7/0216; B67D 2210/0016
See application file for complete search history.

(56) References Cited

U.S. PATENT DOCUMENTS 4,627,551 A 12/1986 Kopp
5,118,011 A 6/1992 Kopp
(Continued)

FOREIGN PATENT DOCUMENTS

AU 2017309920 A1 2/2018
CN 1498183 A 5/2004
(Continued)

OTHER PUBLICATIONS

International Search Report (in English and Chinese) and Written Opinion issued in PCT/CN2018/097328, dated Oct. 26, 2018, total 12 pages.
(Continued)

*Primary Examiner* — Frederick C Nicolas
(74) *Attorney, Agent, or Firm* — Hamre, Schumann, Mueller & Larson, P.C.

(57) ABSTRACT

This invention discloses a fluid discharge system and the squeezer thereof. The squeezer includes a pair of rolling shafts, a driving device, and a mounting bracket, wherein the pair of rolling shafts is rotatably mounted on the mounting bracket. Each rolling shaft has a mounting part at each of both ends and a squeezing segment located between the mounting parts. A pair of rolling shafts can operatively
(Continued)

clamp an object to be clamped between the squeezing segments and can rotate oppositely through a driving device to apply a squeezing force to the object clamped. The squeezing segment includes a supporting shaft and an elastic body provided around the supporting shaft. The squeezer also has a protective device for protecting the elastic body at the end of the squeezing segment. The discharge system provided by this invention is a zero-residue discharge system needing not to hanging the liner bag, and has a simple structure, a good manufacturing process, simple operation, and cost savings.

19 Claims, 7 Drawing Sheets

(51) Int. Cl.
*B67D 7/02* (2010.01)
*B65D 90/00* (2006.01)

(52) U.S. Cl.
CPC ..... *B65D 2590/046* (2013.01); *B67D 2210/0016* (2013.01)

(56) References Cited

U.S. PATENT DOCUMENTS

| | | | | |
|---|---|---|---|---|
| 5,490,613 | A | 2/1996 | Taylor et al. | |
| 5,765,723 | A | 6/1998 | Wilcox | |
| 5,875,929 | A * | 3/1999 | Nguyen | B65D 35/285 222/102 |
| 6,547,099 | B1 * | 4/2003 | Farris | A61M 1/0078 222/102 |
| 6,691,894 | B2 | 2/2004 | Chrisman | |
| 7,111,758 | B1 * | 9/2006 | Monks | A47K 1/09 222/102 |
| 8,550,297 | B2 | 10/2013 | Baker et al. | |
| 2004/0216427 | A1 | 11/2004 | Schroeder et al. | |
| 2015/0284181 | A1 | 10/2015 | Sullinger et al. | |
| 2017/0096293 | A1 * | 4/2017 | Sullinger | B30B 9/20 |
| 2019/0217995 | A1 * | 7/2019 | Fang | B65D 33/01 |

FOREIGN PATENT DOCUMENTS

| | | | |
|---|---|---|---|
| CN | 107472723 | A | 12/2017 |
| CN | 207275422 | U | 4/2018 |
| EP | 3498625 | A1 | 6/2019 |
| JP | 3002156 | U | 9/1994 |
| JP | 3043307 | U | 11/1997 |
| JP | 2014525375 | A | 9/2014 |
| WO | 2011080402 | A1 | 7/2011 |
| WO | 2015192789 | A1 | 12/2015 |

OTHER PUBLICATIONS

The extended European search report issued in European Application No. 18841657.2, dated Oct. 29, 2020.

Notice of Reason for Refusal issued in Japanese Application No. 2020-505372, dated Mar. 30, 2021, with English machine translation.

Examination Report issued in corresponding Australian Application No. 2018310374, dated Jun. 18, 2021.

* cited by examiner

FLUID DISCHARGE SYSTEM AND SQUEEZER THEREOF

CROSS REFERENCE TO RELATED APPLICATIONS

This patent application the priority of Chinese patent application 201710656555.5, entitled "fluid discharge system and the squeezer thereof" filed on Aug. 3, 2017; the entire disclosure thereof is incorporated herein by reference.

TECHNICAL FIELD

This invention relates to logistics transportation field, and in particular a transportation and discharge system for fluid, especially viscous liquid.

TECHNICAL BACKGROUND

There are many liquid storage device in the market for storage, transportation, filling, discharging and the like of viscous liquid.

U.S. Pat. No. 5,765,723A disclosed a sealed liquid bag, the body thereof is a sealed soft container made by hot-melting welding or high-frequency welding PVC plastic-coated cloth; the sealed soft container is provided with an inlet valve and an outlet valve at two ends thereof. This liquid liner bag body is effective when using in the high speed low viscous liquid; however, during viscous liquid discharging, the discharge is inefficient; there are much liquid residues in the bag after discharging, rendering waste of liquid. Generally, at the end of discharging, the liner bag is twisted by spirally twisting and squeezing the body thereof to squeeze the liquid residues out.

IL156984A disclosed a sealed liquid bag, the body thereof is a sealed soft container made by hot-melting welding or high-frequency welding PVC plastic-coated cloth or PE film; the sealed soft container is provided with an inlet valve and an outlet valve at two ends thereof; the body also includes a gas bag for assisting in discharging, with an gas charging port on the gas bag. During liquid discharging, the assisted gas bag need to be charged with gas, the viscous liquid is discharged by the squeezing of the gas. This solution cannot solve the problem of liquid residues completely, and assisted gas charging is needed, rendering the increase of cost.

US2015284181A1 disclosed a sealed liquid bag, the body thereof is a sealed soft container made by hot-melting welding or high-frequency welding PVC plastic-coated cloth or PE film; when viscous liquid discharging, the intermediate bulk container for transporting liquid is tilted by mechanical structure so that the discharging outlet is located at the lowest position. Such an operation is time consuming, inefficient, and inconvenient, further there are much liquid residues in the liner bag after discharging, rendering waste of liquid.

WO2011080402A1 discloses a liquid squeezing device for squeezing viscous liquid. The sealed liquid bag has to be hanged before squeezing, then with the squeezing of the hanged liquid bag, the hanged liquid bag is pulled upwardly. These squeezing device is costly and bulky, and the operation is complicated, time-consuming, inefficient and difficult.

SUMMARY

The invention aims to provide a simple, compact, cost-effective, operation friendly, and durable squeezer with little liquid residue in the squeezed liner bag.

To achieve the above object, according to an aspect of the present invention, it is provided a squeezer, comprising a pair of rolling shafts, a driving device and a mounting bracket, wherein the pair of rolling shafts being rotatably mounted to the mounting bracket, each rolling shaft having a mounting part at each end and a squeezing segment located between the mounting parts; the squeezing segment including a supporting shaft and an elastic body surrounding the supporting shaft; the pair of rollers being capable of operatively clamping an object to be clamped between the squeezing segments and oppositely being rotated by the driving device to apply a squeezing force to the object clamped, and the squeezer further comprising a protective device for protecting the elastic body at ends of the squeezing segment.

Preferably, the protective device is a protective part provided on the mounting bracket, and both ends of the squeezing segment are received in the protective part of the mounting bracket.

Preferably, the mounting bracket comprises a first base and a second base respectively arranged at both ends of the rolling shaft, wherein both the first base and the second base are provided with concave recesses, and both ends of the squeezing segment are respectively received in the recesses of the first base and the second base.

Preferably, the squeezing segment of one of the pair of rolling shafts received in the recess of the first base and the squeezing segment of the other received in the recess of first base are not in contact with each other; and the squeezing segment of one of the pair of rolling shafts received in the recess of the second base and the squeezing segment of the other received in the recess of the second base are not in contact with each other.

Preferably, each of the two ends of the squeezing segment is received in the protective part by a length of 25 mm-60 mm; or, each of both ends of the squeezing segment is received in the protective part by a length of $1/20$ to $1/16$ of the total length of the squeezing segment.

Preferably, the mounting bracket comprises two first bases, two supporting rods, a second base and a locking mechanism; two ends of each of the two supporting rods are connected to the first base and the second base respectively; one end of the rolling shaft is rotatably mounted to the first base, the other end is rotatably mounted to the second base, and the locking mechanism is used to operatively lock or release the pair of rolling shafts.

Preferably, the locking mechanism includes a locking spanner and lateral threaded holes provided on two first bases, wherein the lateral threaded hole on one of the first bases is a through hole and the lateral threaded hole on the other is a through hole or a blind hole, and the locking spanner is screwed through the through threaded hole on one of the first bases into another threaded hole to operatively lock the pair of rollers.

Preferably, the protective device is a concave-convex structure provided on an outer surface of the supporting shaft and an inner surface of the elastic body.

Preferably, the protective device is a protective structure for preventing from rotating relative to each other, and the protective structure is provided at a position on the supporting shaft of the squeezing segment corresponding to the end of the elastic body.

Preferably, the protective structure comprises a plurality of axially extending grooves in a supporting shaft in the squeezing segment; and opposite flanges are provided at the opening of each of the grooves.

Preferably, the driving device is arranged at an end of the rolling shaft, wherein the driving device comprises a motor and a reducer, wherein an output shaft of the reducer and the mounting part of the rolling shaft are connected with each other, and the motor is located above the rolling shaft.

Preferably, the output shaft of the motor is perpendicular to the rolling shaft; or the output shaft of the motor is parallel to the rolling shaft.

Preferably, the cross section of the roller is circular or oval.

Preferably, an outer diameter of at least a part of the elastic body is uniformly changed in the axial direction, thereby forming an elastic body having a taper.

Preferably, the object to be clamped is a liner bag for containing liquid, and the pair of rollers are arranged to be capable of descending as the liquid in the inner liner bag is lowered while rotating relatively in the opposite direction.

Preferably, the cross section of the roller is circular or oval.

According to another aspect of the present invention, it is provided a squeezer, comprising: a pair of rolling shafts, a driving device and a mounting bracket, wherein the pair of rolling shafts being rotatably mounted to the mounting bracket, each rolling shaft having a mounting part at each end and a squeezing segment located between the mounting parts; the squeezing segment including a supporting shaft and an elastic body surrounding the supporting shaft; the pair of rollers being capable of operatively clamping an object to be clamped between the squeezing segments and oppositely being rotated by the driving device to apply a squeezing force to the object clamped, and the squeezer further comprising a protective device for protecting the elastic body at ends of the squeezing segment and a guarding device provided to surround at least the outer side of the rolling shaft so that during the squeezing process of the squeezer, the outer side of the rolling shaft is separated from the object clamped.

Preferably, the guarding device is formed by supporting rods of the mounting bracket, wherein the cross-sectional shape of the supporting rod is U-shaped or C-shaped.

According to yet another aspect of the present invention, it is provided a fluid discharge system comprising a container and a liner bag, said liner bag being provided with a discharge port and installed in the container, wherein the fluid discharge system further comprises the squeezer mentioned above, wherein the pair of rolling shafts operatively clamp the liner bag between the squeezing segments and are able to oppositely rotated by the driving device to apply a squeezing force to the liner bag.

The fluid discharge system provided by this invention is a zero-residue discharge system needing not to hanging the liner bag, and has a simple structure, a good manufacturing process, simple operation, and cost savings.

DESCRIPTION OF DRAWINGS

FIGS. 12-13 show the variant of the squeezer in FIG. 4, wherein FIG. 12 is the perspective view, and FIG. 13 is the sectional view.

DETAILED DESCRIPTION

The preferred embodiment of this invention will be described in detail with reference to the accompanying drawings, so that the purposes, the characteristics and the advantages of the invention can be more clearly understood. It should be understood that the embodiments shown in the figures are not intended to limit the scope of this invention, but illustrate the essential spirit of the technical solution of this invention.

Description for Terms

Intermediate bulk container: composite intermediate bulk container (hereinafter referred to as IBC container) is a type of packaging and transportation containers widely used in the food, biochemical, pharmaceutical, chemical and other industries in the world. Since IBC container barrels can be reused many times, they have obvious advantages in filling, storage, and transportation, and compared to cylindrical barrels, IBC container barrels can save 35% of storage space, the dimensions accord with ISO standards, and not only applicable to sterile filling but also compact, convenient for safe and efficient storage in large scale, so it is widely used in the transportation, packaging, and storage of liquids, particles, and flakes etc. At present, there are three types of existing specifications: 820 L, 1000 L, and 1250 L. Generally, their structure includes a plastic liner (lined bag), a filling port, a draining device (a valve or a simple draining port, etc.), a side plate, a base and a cover.

The squeezer of the present invention includes at least a pair of squeezing members, such as at least two rolling shafts. When the liquid in the liner bag is needed to be discharged, the two rolling shafts clamp the liner bag, and under the driving of the driving device, the two rolling shafts rotate relative to each other to squeeze out the liquid in the liner bag, and during liquid discharging, with the reducing of the liquid in the liner bag, the two rolling shafts are always automatically descend as the liquid level decreases and squeeze the liquid under the driving of the driving device. Herein, the squeezing force is produce squeezing and pushing effect to an object, for example the liner bag and the liquid contained therein.

Next, the embodiments of this invention are described reference to figures.

The First Embodiment

Figure 1:
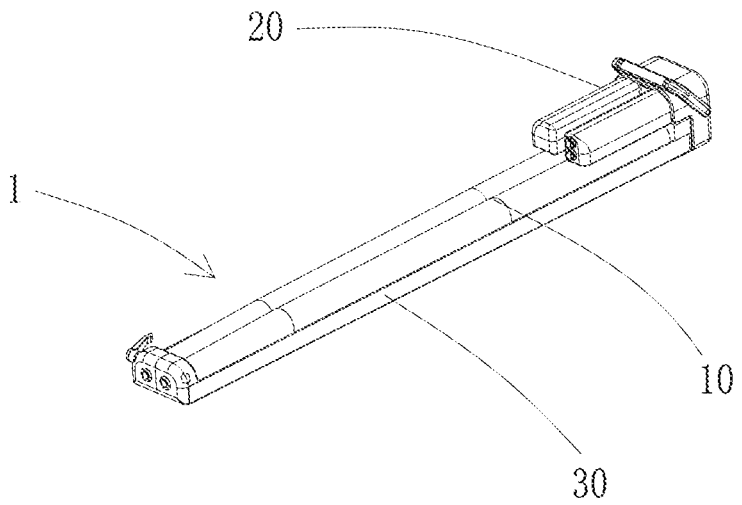
FIG. 1 is the perspective view of the squeezer according to the first embodiment of this invention.
Figure 2:
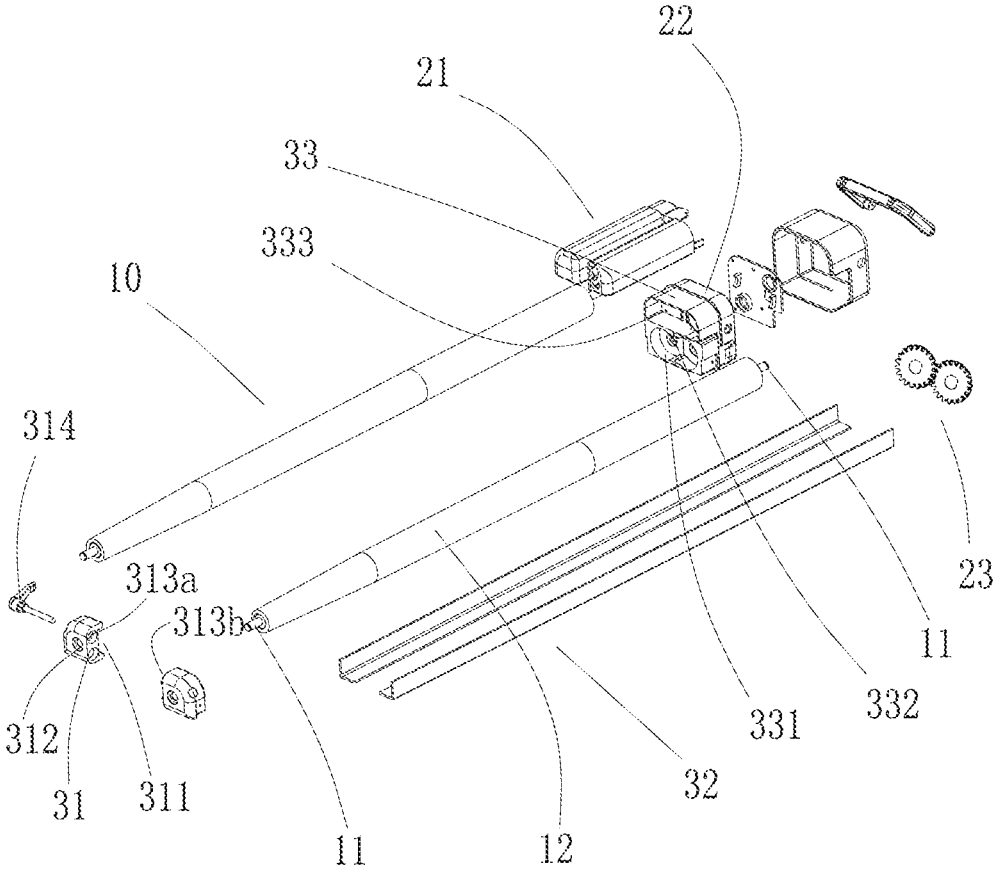
FIG. 2 is the explosive view of the squeezer in FIG. 1.
Figure 3:
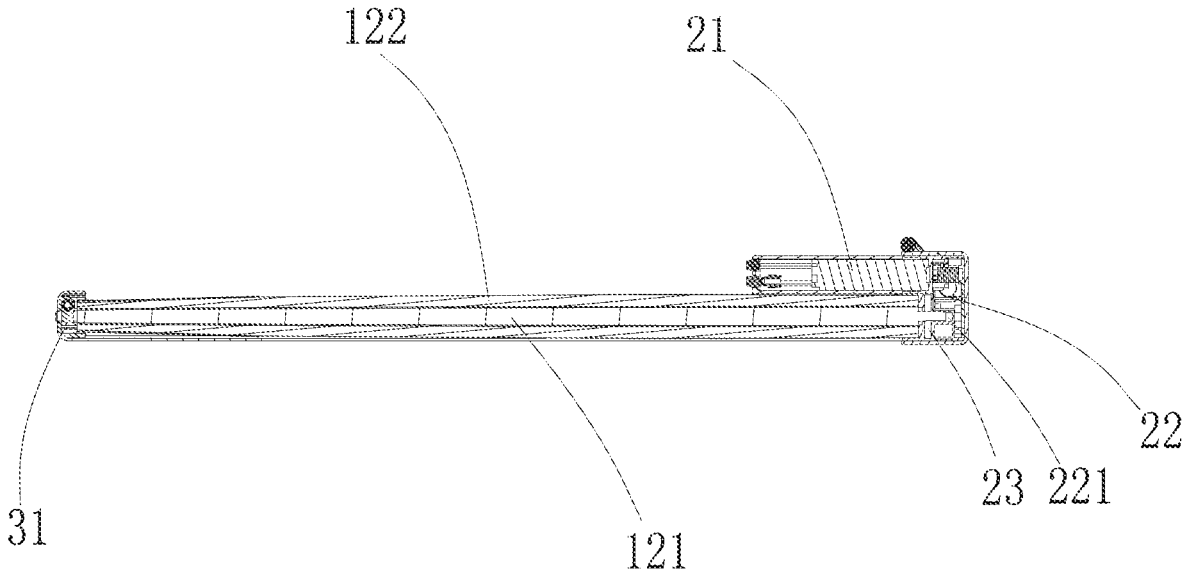
FIG. 3 is the sectional view of the squeezer in FIG. 1.

Next, the first embodiment of this invention is described reference to FIGS. 1-3.

Figure 7:
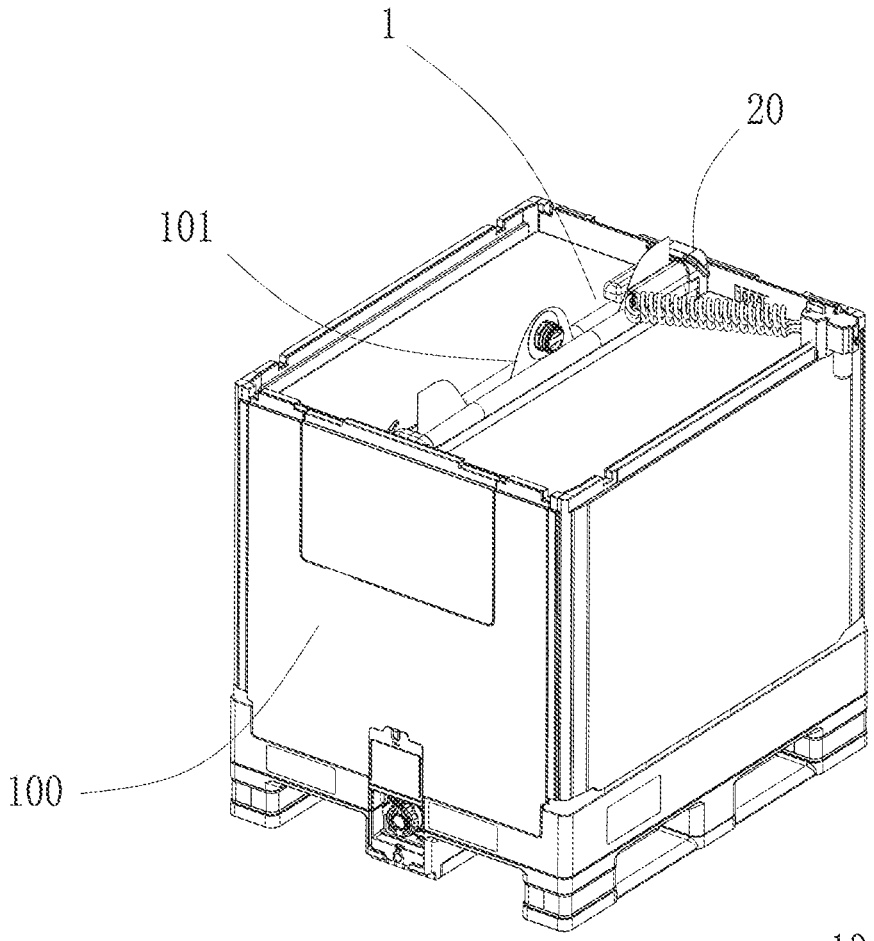
FIG. 7 is the perspective view of the fluid discharge system according to the embodiment of this invention.

As shown in FIGS. 1-3, the squeezer includes a pair of rolling shafts 10, a driving device 20 and a mounting bracket 30. Each rolling shaft 10 includes mounting parts 11 at the ends thereof and a squeezing segment 12 between the mounting parts 11. In this embodiment, the mounting parts 11 and the squeezing segment 12 are integral, however they can also be formed separately and assembled together. The rolling shaft 10 is long rod-shaped, and its dimension in the axial direction is much larger than its dimension in the radial direction, and the length of the mounting part 11 is much smaller than that of the squeezing segment 12. The squeezing segment 12 is used to contact the bag body of the liner bag 101 (as shown in FIG. 7), thereby squeezing the bag body, which will be described in detail below. The squeezing segment 12 includes a supporting shaft 121 and an elastic body 122 surrounding the supporting shaft 121. Preferably, the elastic body 122 is an elastic soft body made of rubber, resin, or other high-molecular elastic materials.

Specifically, the elastic body 122 is cylindrical in shape, and has an inner cavity with an inner diameter matching the outer diameter of the supporting rod 121. The supporting rod 121 inserts into the inner cavity of the elastic body 122. The outer surface of the supporting shaft 121 can be coated with glue. The elastic body 122 is wrapped around and attached to the entire outer surface of the supporting shaft 121, so that when the supporting shaft 121 rotates under the driving of the driving device, the elastic body 122 rotates synchronously. Alternatively, the elastic body 122 is integrated with the support shaft 121 by injection molding.

Figure 4:
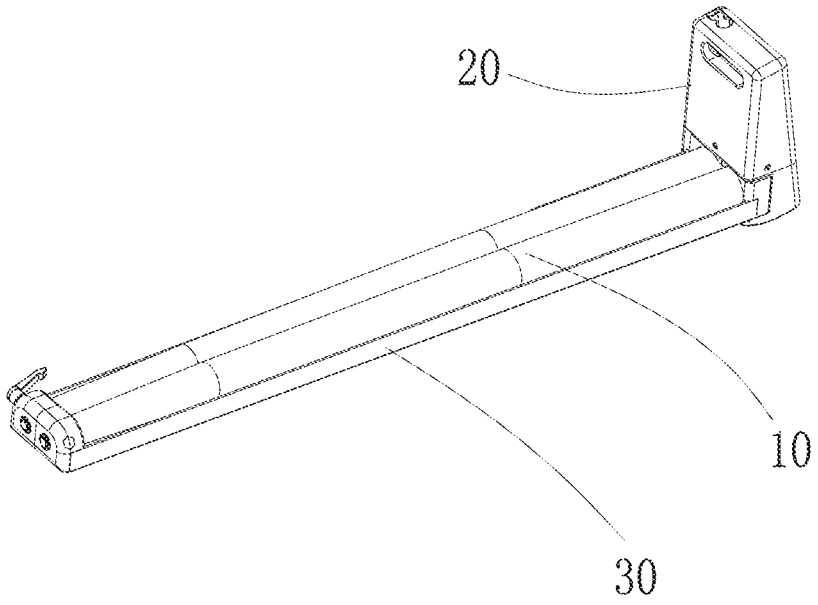
FIG. 4 is the perspective view of the squeezer according to a variant of the first embodiment of this invention.
Figure 5:
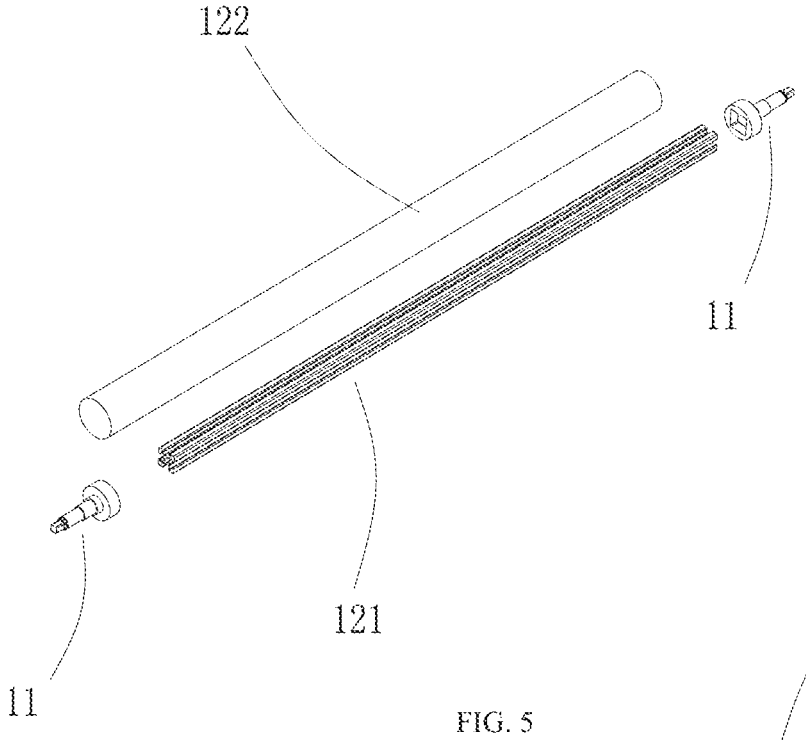
FIG. 5 is the perspective view of the rolling shaft of the squeezer according to the second embodiment of this invention.
Figure 6:
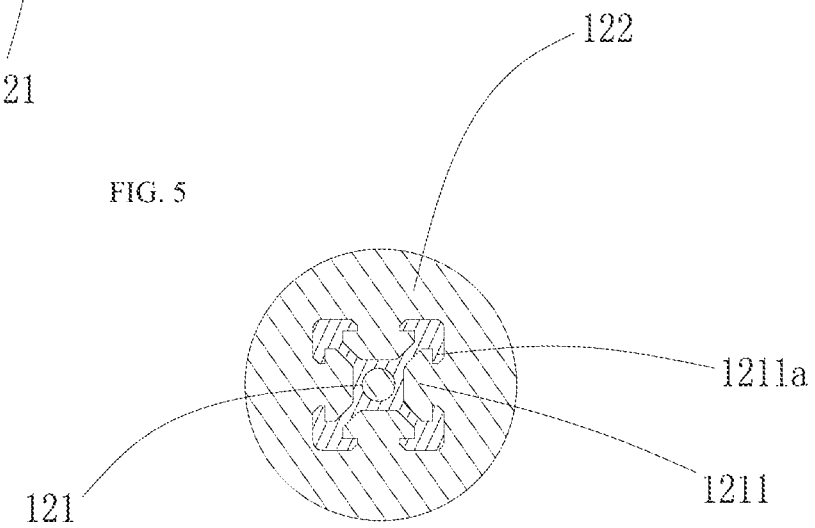
FIG. 6 is the cross-section schematic view of the squeezing segment of the rolling shaft in FIG. 5.

It should be understood that the elastic body 122 of the rolling shaft 10 can also be other shape, such as ellipse, triangle, or square. The mounting part 11 is cylindrical shaft, so as to rotatably mounted in the mounting bracket 30. In this embodiment, the supporting shaft 121 is generally cylindrical, that is, the outer diameter of the supporting shaft is constant in the axial direction; while the outer diameter of the elastic body 122 changes uniformly in the axial direction, thereby forming an elastic body with a taper. However, in other embodiments, the outer diameter of the elastic body 122 can also be substantially constant in the axial direction (as shown in FIG. 4), or only the outer diameter of a part of the elastic body 122 changes uniformly in the axial direction.

In this embodiment, the mounting bracket 30 includes two first bases 31, two supporting rods 32 and a second base 33. The two supporting rods 32 connect two first bases 31 with the second base 33, that is, two ends of the supporting rod 32 are connected with the first base 31 and the second base 33 respectively. The first base 31 has a concave recess 311 and a mounting hole 312. The second base 33 has a recess 331, an upper mounting hole 333, and a lower mounting hole 332. The mounting parts 11 at two ends of the rolling shaft 10 are mounted rotatably in the mounting holes 312 and 332 respectively, and the two ends of the squeezing segment 12 are received in the recesses 311 and 331 respectively, so that during squeezing, the ends of the squeezing segment 12 will not contact the object clamped (for example, the liner bag 101). That is, the recesses 311 and 331 function as protective parts for the ends of the squeezing segment 12, so as to ensure that the elastic body of the squeezing segment 12 will not be separated from the supporting shaft or being damaged during squeezing.

In some embodiments, the length of each of the two ends of the squeezing segment 12 received in the recesses 311 and 331 (protective parts) is 25 mm-60 mm. Preferably, the length of each of the two ends of the squeezing segment 12 received in the recesses 311 and 331 (protective parts) is 35 mm-50 mm. Preferably, the length of each of the two ends of the squeezing segment 12 received in the recesses 311 and 331 is 40 mm. Alternatively, the length of each end of the squeeze segment 12 received in the recesses 311 and 331 is 1/20 to 1/16 of the total length of the squeezing segment 12.

Preferably, the squeezing segment of one of the pair of rolling shafts 10 received in the recess 311 of the first base 31 and the squeezing segment of the other received in the recess of first base 31 are not in contact with each other; and the squeezing segment of one of the pair of rolling shafts 10 received in the recess of the second base 33 and the squeezing segment of the other received in the recess 331 of the second base 33 are not in contact with each other. Therefore, during the working process, the ends of the pair of rolling shafts will not rub against each other, thereby ensuring that the elastic body of the squeezing segment 12 will not be damaged or separated.

Of course, the mounting bracket 30 can also has other configurations. For example, the supporting rod 32 can be eliminated, the first base 31 can be an integral structure, or the second base 33 can have two separate parts.

In this embodiment, the first base 31 is provided with a locking mechanism. In particular, one of the first bases 31 is provided with a threaded through hole 313*a*, and the other is provided with a threaded hole 313*b*. The locking spanner 314 can be screwed into the threaded hole 313*b* via the threaded through hole 313*a* so as to operatively lock the pair of rolling shafts 10 together, and vice versa. The threaded hole 313*b* can be a through hole or a blind hole. Of course, the locking mechanism can also in other configurations, for example locking by buckling.

In this embodiment, the driving device 20 includes a motor 21, a reducer 22, and a transmission gear 23. The motor 21 and the reducer 22 are mounted on the mounting bracket 30. In particular, the reducer 22 is provided in the second base 33. One end of the motor 21 is mounted in the upper recess 332 of the second base 33, that is, the motor 21 is mounted above the rolling shaft 10, and the output shaft thereof extends parallel to the axial direction of the rolling shaft 10 and is drivingly connected with the reducer 22. The output shaft of the reducer is connected with the mounting part of the rolling shaft, so that the motor drives the reducer to rotate, and then drives the rolling shaft to rotate.

In other embodiments, the reducer 22 and the second base 33 can be formed separately and fixed together by a fixing device. Further, in the variant of this embodiment, the motor 21 can also be mounted above the rolling shaft 10 and perpendicular to the rolling shaft (as shown in FIG. 7), that is, the output shaft of the motor 21 extends perpendicular to the axial direction of the rolling shaft and is drivingly connected with the reducer 22. The reducer 22 and the end of one of the supporting shaft 121 are drivingly engaged, for example, the end of one of the supporting shaft 121 is engaged in the driving slot 221 of the reducer 22. The transmitting gears are provided on the mounting parts 11 of the two supporting shaft 121 respectively, so that when the two rolling shafts 10 are locked together, the transmitting gears on the two rolling shafts 11 are engaged with each other. In this embodiment, the transmitting gear 23 is in the lower recess 331 of the second base 33. When the motor 21 drives one of the rolling shaft 10 to rotate through the reducer 22, the other rolling shaft 10 can be driven to rotate, so as to apply squeezing force to the object clamped. Of course, in some embodiments, the driving device 20 may not include the transmitting gear 23. Alternatively, two driving slots may be provided in the reducer, which are respectively drivingly engaged with the ends of the pair of rolling shafts 10.

The Second Embodiment

Next, the second embodiment of this invention is described reference to FIGS. 1, 2, 4 and 5. The main difference between the second embodiment and the first embodiment is that in the second embodiment, the supporting shaft 121 in the squeeze segment 12 of the rolling shaft 10 is not cylindrical, but has a protective device for preventing relative rotation between the supporting shaft 121 and the elastic body 122, so as to prevent the elastic body 122 from separating from the supporting shaft 121. Specifically, the outer surface of the supporting shaft 121 has four grooves 1211 extending in the axial direction, and opposite flanges 1211*a* are provided at the opening of each groove 1211, that is, the groove 1211 is substantially C-shaped. The flanges 1211*a* is used to prevent the supporting shaft 121 and the elastic body from rotating relatively, thereby prevent the elastic body 122 from separating from the supporting shaft 121. It should be understood, the number of the grooves 1211 is not limited to the number shown in figures, it can be 3, 5, or 6, etc.; or the grooves 1211 may also be provided only on the position in the supporting shaft 121 in the squeezing segment 12 where corresponds to the ends of the elastic body 122. In addition, the protective structure may also adopt other structures, such as a concave-convex structure provided on an outer surface of both end parts of the supporting shaft 121 and the inner surface of the elastic body 122. In this embodiment, the mounting part 11 is not integrally formed with the supporting shaft 121 of the squeezing segment 12, but is sleeved over the supporting shaft 121. However, in other embodiments, the mounting part 11 and the supporting shaft 121 of the squeezing segment 12 can also be formed integrally (as shown in the first embodiment).

It should be noted that, because the supporting shaft 121 has a function of preventing the elastic body 122 from separating from it in the second embodiment, that is, protecting the squeezing segment 12 from being damaged and separating from it during the squeezing process. Therefore, two ends of the squeezing segment 12 of the rolling shaft 10 are not needed to be received in the recess 311 of the first base 31 and the recess 331 of the second base 33 (as shown in FIG. 2).

Figure 8:
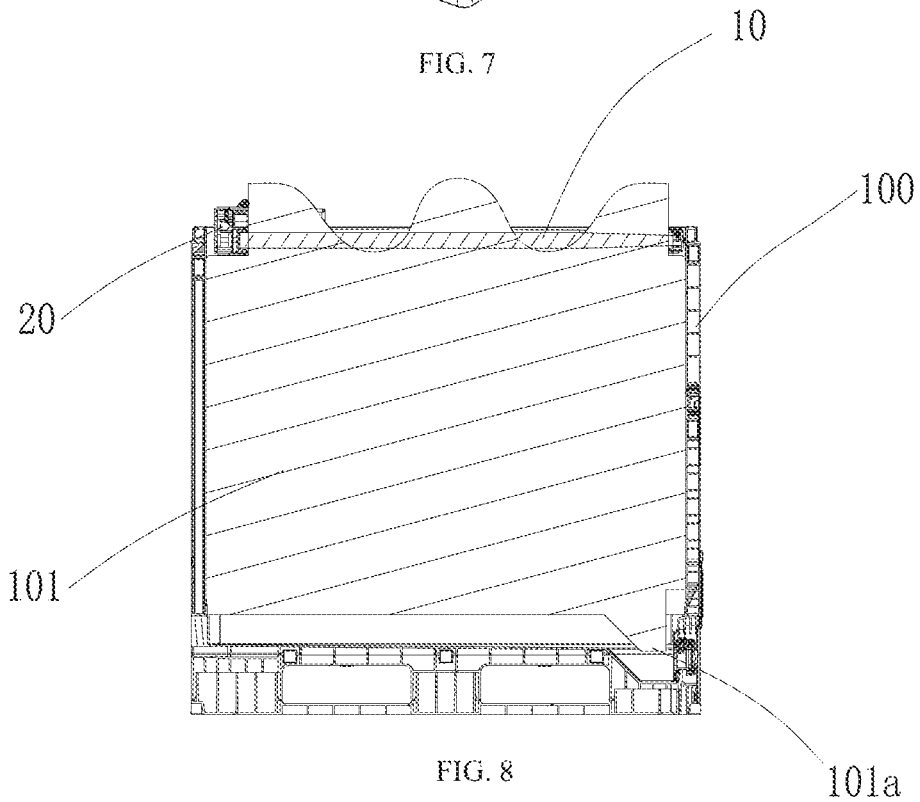
FIG. 8 is an sectional view of the fluid discharge system in FIG. 7.
Figure 9:
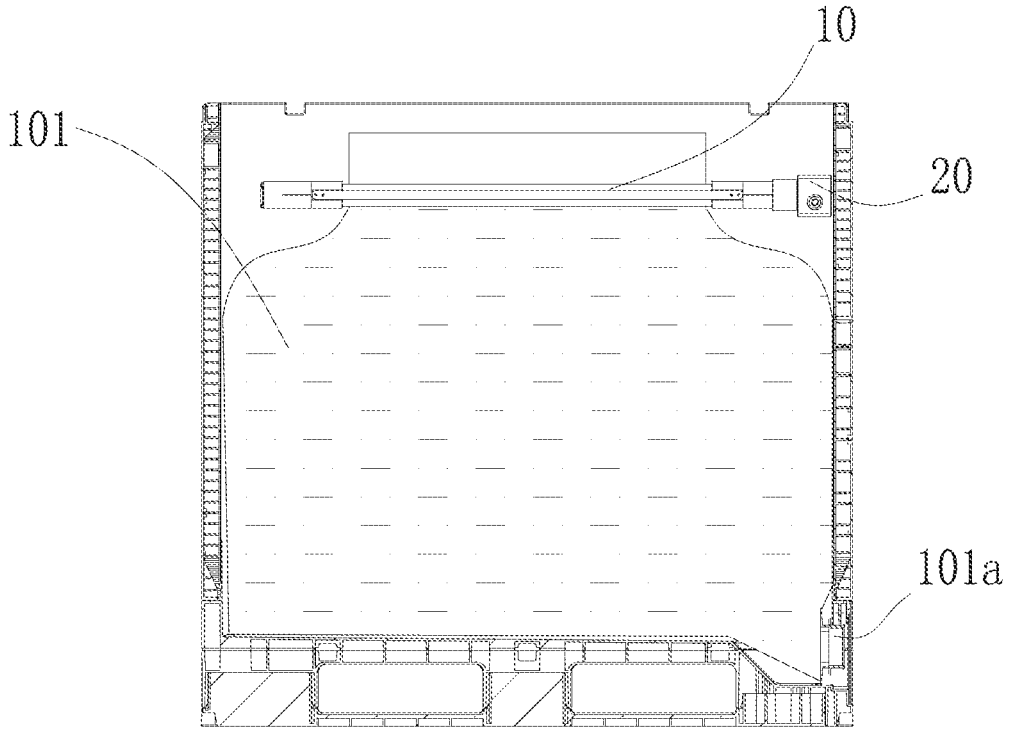
FIGS. 9-11 are the cross-section views of the fluid discharge system according to the embodiment of this invention, showing the different phases during fluid discharging.
Figure 10:
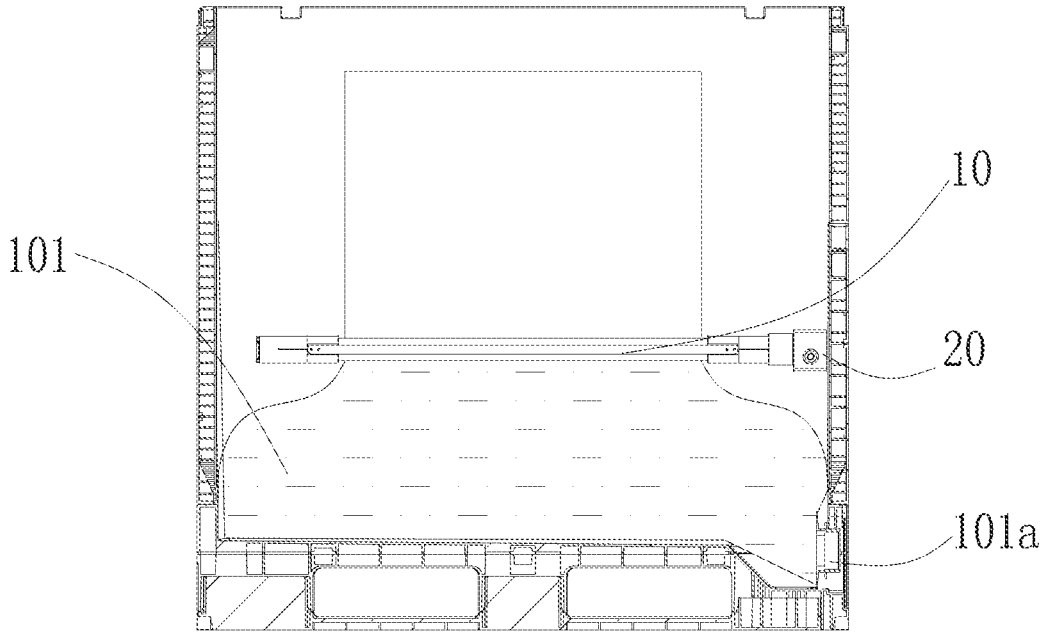
Figure 11:
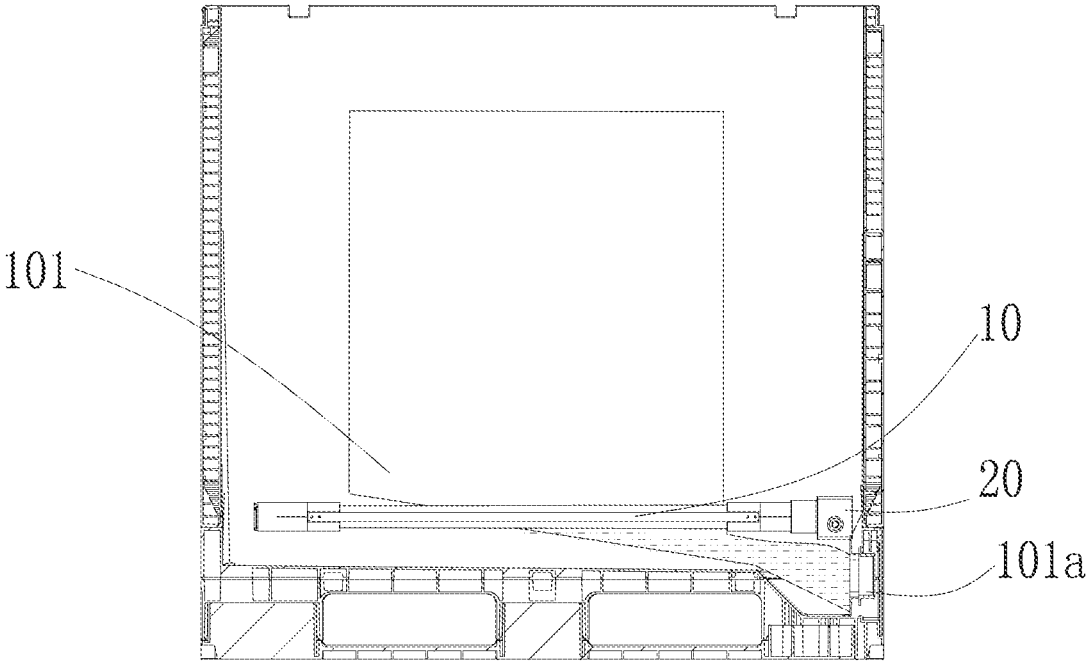

FIG. 7 is a perspective view of the discharge system according to the embodiment of this invention. FIG. 8 is an sectional view of the discharge system in FIG. 7. FIGS. 9-11 are the cross-section views of the fluid discharge system according to the embodiment of this invention, showing the different phases during fluid discharging.

As shown in FIGS. 7 and 8, the fluid discharge system may includes a container 100, a liner bag 101 and a squeezer 1. The container 100 is generally an intermediate bulk container. The liner bag 101 is provided with a discharge port 101*a* and is installed in the container 100. The squeezer 1 includes a pair of rolling shafts 10 and a driving device 20. With reference to FIGS. 7-11, the discharge process of the fluid discharge system will be described. Firstly, the liner bag 101 is clamped between the pair of rolling shafts 10 (as shown in FIG. 7). In particular, the pair of rolling shafts 10 are separated by the locking spanner, and then the upper part of the liner bag 101 is clamped in the squeezer 1 of the container 100, then the pair of rolling shafts 10 are locked together by the locking spanner. Next, the driving device 20 is activated, when driven by the driving device 20, the pair of rolling shafts 10 of the squeezer rotate downwardly and oppositely and squeeze the bag of the liner bag 101, so as to squeeze the liquid in the liner bag 101, and discharge the liquid from the discharge port 101*a*. During liquid discharging, as the liquid in the liner bag decreases, the pair of rolling shafts 10 automatically descend with the liquid level descending through the driving of the driving device 20 and squeeze the liquid (as shown in FIGS. 9-11). During the squeezing process, due to the protective device, the elastic body and supporting shaft of the rolling shaft 10 will not be separated from each other or damaged.

Figure 12:
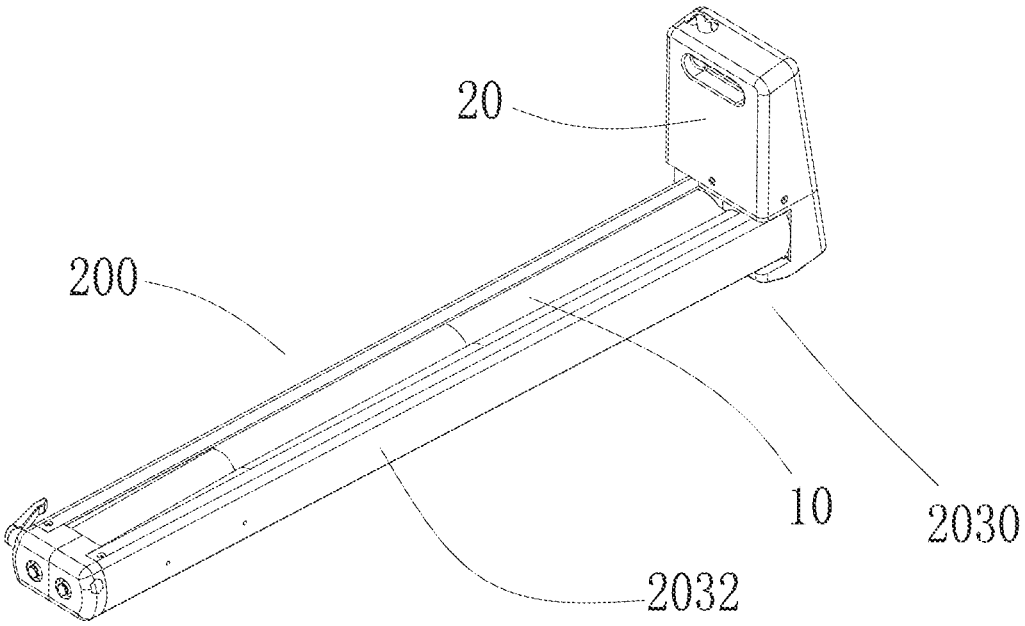
Figure 13:
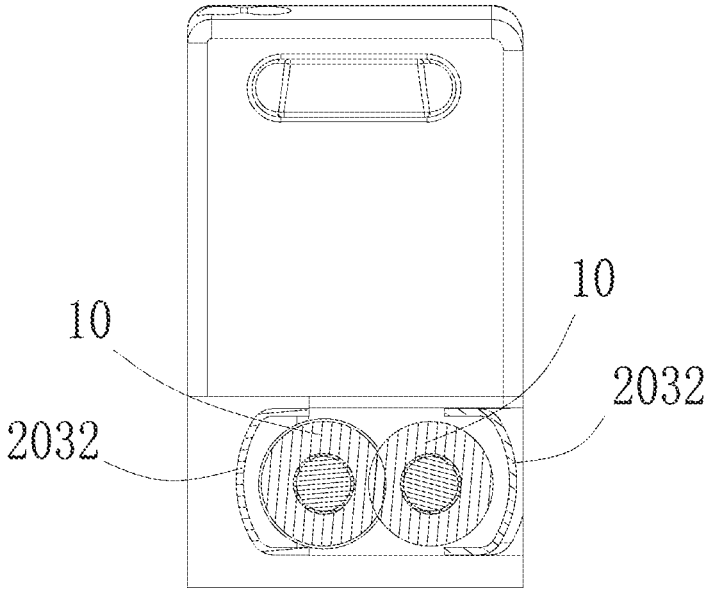

FIGS. 12-13 are schematic diagrams showing the variant of the squeezer in FIG. 4. The differences between the embodiment shown in FIGS. 12-13 and the embodiment shown in FIG. 4 are the structure of the mounting bracket 2030, in particular the structure of the supporting rod. As shown in FIG. 13, in this embodiment, the cross section of the supporting rod 2032 in the squeezer 200 is different from that of the supporting rod shown in FIGS. 2 and 4. In this embodiment, the cross section of the supporting rod 2032 is U-shaped. Thereby, the supporting rod 2032 can surround the outer side of the rolling shaft, preventing the outer side of the rolling shaft from contacting the clamped object, that is, spacing the outer side of the rolling shaft from the clamped object, and further preventing hands of the operator from being clamped by the rolling shafts. Here, the outer side refers to the side of the rolling shaft opposite to the side contacting the clamped object.

In this embodiment, the cross section of the supporting rod 2032 can also be C-shaped, or the protective part can have other shapes or configurations, as long as it can surround the outer side of the rolling shaft, such that during the squeezing of the squeezer, and the outer side of the rolling shaft is separate from the clamped object.

The preferred embodiments of the present invention have been described in detail above, but it should be understood that those skilled in the art can make various changes or modifications of the present invention after reading the above teachings of the present invention. These equivalent forms also fall within the scope defined by the claims appended hereto.

The invention claimed is:

1. A squeezer, comprising:

a pair of rolling shafts, a driving device, and a mounting bracket, wherein the pair of rolling shafts being rotatably mounted to the mounting bracket, each rolling shaft having a mounting part at each end and a squeezing segment located between the mounting parts; the squeezing segment including a supporting shaft and an elastic body surrounding the supporting shaft; the pair of rollers being capable of operatively clamping an object to be clamped between the squeezing segments and oppositely being rotated by the driving device to apply a squeezing force to the object clamped, and the squeezer further comprising a protective device for protecting the elastic body at ends of the squeezing segment, wherein the protective device comprises a protective part provided on the mounting bracket, and both ends of the squeezing segment are received in the protective part of the mounting bracket.

2. The squeezer according to claim 1, wherein the mounting bracket comprises a first base and a second base respectively arranged at both ends of the rolling shaft, wherein both the first base and the second base are provided with concave recesses, and both ends of the squeezing segment are respectively received in the recesses of the first base and the second base.

3. The squeezer according to claim 2, wherein the squeezing segment of one of the pair of rolling shafts received in the recess of the first base and the squeezing segment of the other received in the recess of first base are not in contact with each other; and the squeezing segment of one of the pair of rolling shafts received in the recess of the second base and the squeezing segment of the other received in the recess of the second base are not in contact with each other.

4. The squeezer according to claim 2, wherein each of the two ends of the squeezing segment is received in the protective part by a length of 25 mm-60 mm; or, each of both ends of the squeezing segment is received in the protective part by a length of 1/20 to 1/16 of the total length of the squeezing segment.

5. The squeezer according to claim 1, wherein the mounting bracket comprises two first bases, two supporting rods, a second base and a locking mechanism; two ends of each of the two supporting rods are connected to the first base and the second base respectively; one end of the rolling shaft is rotatably mounted to the first base, the other end is rotatably mounted to the second base, and the locking mechanism is used to operatively lock or release the pair of rolling shafts.

6. The squeezer according to claim 1, wherein the protective device further comprises a concave-convex structure provided on an outer surface of the supporting shaft and an inner surface of the elastic body.

7. The squeezer according to claim 1, wherein the protective device further comprises a protective structure for preventing from rotating relative to each other, and the protective structure is provided at a position on the supporting shaft of the squeezing segment corresponding to the end of the elastic body.

8. The squeezer according to claim 7, wherein the protective structure comprises a plurality of axially extending grooves in a supporting shaft in the squeezing segment; and opposite flanges are provided at the opening of each of the grooves.

9. The squeezer according to claim 1, wherein the driving device is arranged at an end of the rolling shaft, wherein the driving device comprises a motor and a reducer, wherein an output shaft of the reducer and the mounting part of the rolling shaft are connected with each other, and the motor is located above the rolling shaft.

10. The squeezer according to claim 9, wherein the output shaft of the motor is perpendicular to the rolling shaft; or the output shaft of the motor is parallel to the rolling shaft.

11. A fluid discharge system comprising a container and a liner bag, said liner bag being provided with a discharge port and installed in the container, wherein the fluid discharge system further comprises the squeezer according to claim 1, wherein the pair of rolling shafts operatively clamp the liner bag between the squeezing segments and are able to oppositely rotated by the driving device to apply a squeezing force to the liner bag.

12. The fluid discharge system according to claim 11, wherein the mounting bracket comprises a first base and a second base respectively arranged at both ends of the rolling shaft, wherein both the first base and the second base are provided with concave recesses, and both ends of the squeezing segment are respectively received in the recesses of the first base and the second base.

13. The fluid discharge system according to claim 12, wherein the squeezing segment of one of the pair of rolling shafts received in the recess of the first base and the squeezing segment of the other received in the recess of first base are not in contact with each other; and the squeezing segment of one of the pair of rolling shafts received in the recess of the second base and the squeezing segment of the other received in the recess of the second base are not in contact with each other.

14. The fluid discharge system according to claim 11, wherein the protective device is a concave-convex structure provided on an outer surface of the supporting shaft and an inner surface of the elastic body.

15. The fluid discharge system according to claim 11, wherein the protective device is a protective structure for preventing from rotating relative to each other, and the protective structure is provided at a position on the supporting shaft of the squeezing segment corresponding to the end of the elastic body.

16. The fluid discharge system according to claim 11, wherein the squeezer further comprising a protective device for protecting the elastic body at ends of the squeezing segment and a guarding device provided to surround at least the outer side of the rolling shaft so that during the squeezing process of the squeezer, the outer side of the rolling shaft is separated from the object clamped.

17. The fluid discharge system according to claim 16, wherein the guarding device is formed by supporting rods of the mounting bracket, wherein the cross-sectional shape of the supporting rod is U-shaped or C-shaped.

18. A squeezer, comprising: a pair of rolling shafts, a driving device and a mounting bracket, wherein the pair of rolling shafts being rotatably mounted to the mounting bracket, each rolling shaft having a mounting part at each end and a squeezing segment located between the mounting parts; the squeezing segment including a supporting shaft and an elastic body surrounding the supporting shaft; the pair of rollers being capable of operatively clamping an object to be clamped between the squeezing segments and oppositely being rotated by the driving device to apply a squeezing force to the object clamped, and the squeezer further comprising a protective device for protecting the elastic body at ends of the squeezing segment and a guarding device provided to surround at least the outer side of the rolling shaft so that during the squeezing process of the squeezer, the outer side of the rolling shaft is separated from the object clamped.

19. The squeezer according to claim 18, wherein the guarding device is formed by supporting rods of the mounting bracket, wherein the cross-sectional shape of the supporting rod is U-shaped or C-shaped.

* * * * *